US005101086A

United States Patent [19]

Dion et al.

[11] Patent Number: 5,101,086

[45] Date of Patent: Mar. 31, 1992

[54] ELECTROMAGNETIC INDUCTOR WITH FERRITE CORE FOR HEATING ELECTRICALLY CONDUCTING MATERIAL

[75] Inventors: Jean-Luc Dion; Rémy Simard, both of Trois-Rivières, Canada

[73] Assignee: Hydro-Quebec, Montreal, Canada

[21] Appl. No.: 603,150

[22] Filed: Oct. 25, 1990

[51] Int. Cl.[5] ..... H05B 6/42

[52] U.S. Cl. ..... 219/10.491; 219/10.61 A; 219/10.75; 219/10.79

[58] Field of Search ..... 219/10.75, 10.491, 10.492, 219/10.61 R, 10.61 A, 10.71, 10.79

[56] References Cited

U.S. PATENT DOCUMENTS

| | | | |
|---|---|---|---|
| 4,602,140 | 7/1986 | Sobolewski | 219/10.51 |
| 4,621,177 | 11/1986 | Pulkowski et al. | 219/10.492 |
| 4,673,781 | 6/1987 | Nuns et al. | 219/10.491 |
| 4,675,487 | 6/1987 | Verkasalo | 219/10.492 |
| 4,843,201 | 6/1989 | Griffith | 219/10.491 |
| 4,960,967 | 10/1990 | Buffenoir et al. | 219/10.491 |
| 5,003,145 | 3/1991 | Nolle et al. | 219/10.491 |

*Primary Examiner*—Philip H. Leung
*Attorney, Agent, or Firm*—Oblon, Spivak, McClelland, Maier & Neustadt

[57] ABSTRACT

An induction heating device for heating electrically-conducting material to temperatures of up to at least 300° C. The device comprises an open core of ferrite material. A coil of Litz wire is wound around the core. A power source is connected across the coil to produce an excitation current in the coil, within a frequency range from 12 to 25 kHz, to generate a variable magnetic field when energized. Magnetic flux concentrator tubes of electrically-conductive material are disposed about the coil and close to the core embedded in a thermo-conductive electrically-insulating, material in the intend of maximizing the useful flux. A cooling fluid circulates through the concentrator tubes for cooling the tubes, the core and the coil. An induction zone is defined by said magnetic field generated between the opposed poles of the core and penetrating at the surface of the body to be heated. The body is heated by the eddy currents generated by the variable magnetic field on the surface.

9 Claims, 2 Drawing Sheets

ELECTROMAGNETIC INDUCTOR WITH FERRITE CORE FOR HEATING ELECTRICALLY CONDUCTING MATERIAL

BACKGROUND OF INVENTION

1. Field of Invention

The present invention relates to an induction heating device utilizing an open core of ferrite material provided with a coil of Litz wire in which passes an excitation current to produce a variable magnetic field which is concentrated in a high flux density between the poles of the open core by means of magnetic flux concentrator which are made of electrically conductive tube is close contact with a thermally conductive and electrically non conductive material to drain the heat generated in the coil and in the core, wherein a cooling fluid is circulated through the concentrator tube.

2. Description of Prior Art

A variety of types of high frequency induction heating devices have been proposed in the prior art. U.S. Pat. No. 4,359,620 provides a good summary of the prior art where it is described that one of the problems encountered with many induction heaters, utilizing magnetic cores, is that of high heat losses in their core. This is particularly true if the field intensity and frequency of the fluctuating magnetic field generated is increased sufficiently to be adequate to, for example, solder metal. However, this causes the problem of increasing the temperature of the core, and the core begins to melt. Cores made of laminated magnetic materials used in most of transformers have very high losses due to both eddy currents and to the resulting skin effect at frequencies above 20 Kc. Also, the conductive nature of core laminates present a real danger of electrical shock when used in induction heaters which have a large amount of power supplied to their exciting coils.

In attempt to diminish this problem, U.S. Pat. No. 2,785,263 discloses the use of cores made of ferrite. Such material has relatively high magnetic permeability and low conductivity and has been found to be an ideal material for use in induction heaters. However, other problems have resulted by the use of such cores and namely that in order to saturate the pole pieces so that they can contribute to the maximum to the flux density generated in a work piece placed between them, it is necessary to sature substantially to whole core, and this is very inefficient and at high frequencies result in huge heat losses. U.S. Pat. No. 4,359,620 attempts to solve this further problem by utilizing a core design which focuses a magnetic field of high flux density between its two ends which are closely spaced and tapered. A periodic voltage is supplied to the coil and a capacitance is connected with the exciting coil to form a resonance circuit which is used to control the frequency and phase of the periodic voltage supplied to the resonance circuit to maintain it in resonance. Again, this patent does not deal with the high heat losses in the core and the problem of the core and the coil being subjected to high temperatures which places a restraint on the magnitude of the intensity of the flux density of the magnetic field generated, thereby limiting the application of the induction heater due to its poor heat resistance and lack of uniform heating.

SUMMARY OF THE INVENTION

It is therefore a feature of the present invention to provide an improved induction heating device for heating ferromagnetic material to temperatures of up to at least 300° C. and which overcomes the above mentioned disadvantages of the prior art.

Another feature of the present invention is to provide an improved induction heating device for heating ferromagnetic material to temperatures of up to at least 300° C. and wherein the core is made of ferrite material and utilizes a coil of Litz wire and wherein the improvement resides in that magnetic concentrator tubes are disposed about the coil in close proximity to the core with a cooling fluid circulating therethrough to cool the core and the coil. This permits excitation currents to be applied to the coil in a frequency ranges of from 12 to 25 kHz so that the eddy currents in the magnetic field produced can generate from 4 to 20 kW of heat in an electrically conductive, mainly ferromagnetic surface positioned in the field. Temperatures, frequencies and power given values are only for illustration and in no way limitative values.

Another feature of the present invention is to provide an improved induction heating device as above described and further, wherein the core and the coil are mounted in a thermo-conductive, electrically-insulating material which is a composite material made of epoxy and copper or aluminium powder.

Another feature of the present invention is to provide an improved induction heating device as above described wherein the core is a E-shaped core defining two opposed poles and one central pole between which a magnetic field is generated, around the central pole, the coil being wound with concentrator tubes being disposed about the coil and in close proximity to the opposed poles, to increase the magnetic flux generated between the poles, outside on the surface to be heated.

BRIEF DESCRIPTION OF DRAWINGS

A preferred embodiment of the present invention will now be described with reference to the example thereof as illustrated in the accompanying drawings in which.

DESCRIPTION OF PREFERRENT EMBODIMENTS

Figures 1, 1A:
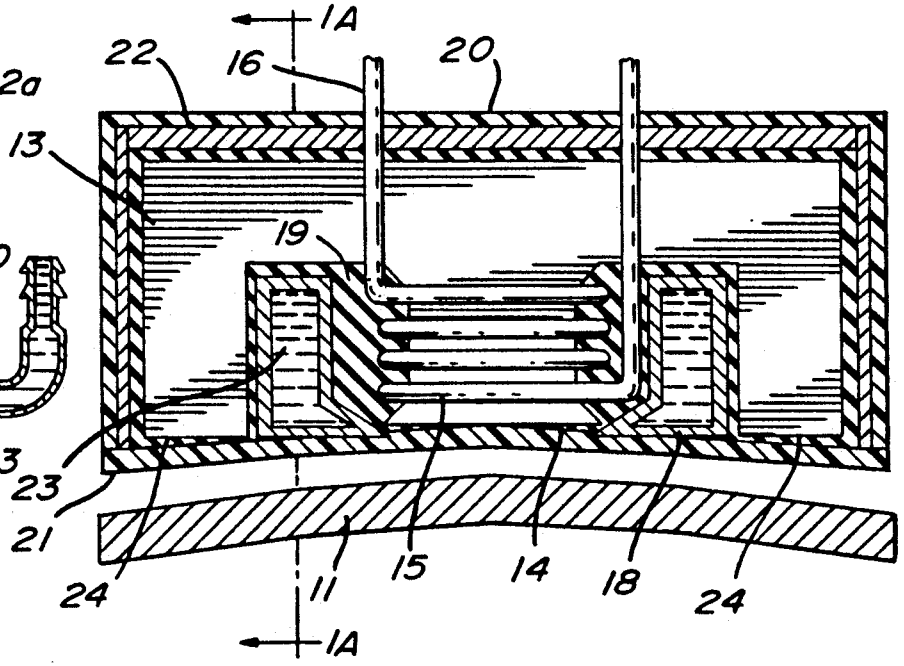
FIGS. 1 and 1A are cross-section views of an induction heating device constructed in accordance with the present invention.

Referring now to the drawings and more particularly to FIG. 1, there is shown generally at 10 the induction heating device of the present invention as herein shown closely spaced to the surface of a calender roll 11 of the a paper making machine whereby to heat the ferromagnetic material disposed on the outer surface of the calender roll. The heating device comprises a ferrite core 12 which is a E-shaped core defining opposed arms 13 and 13' and a central leg 14 about which a coil 15 of Litz wire is wounded. The coil 15 has terminal wires 16 to which a controllable power source 17 (see FIG. 2) is connected so as to supply an excitation current to the coil in a frequency range of from 12 to 25 kHz.

Figure 2:
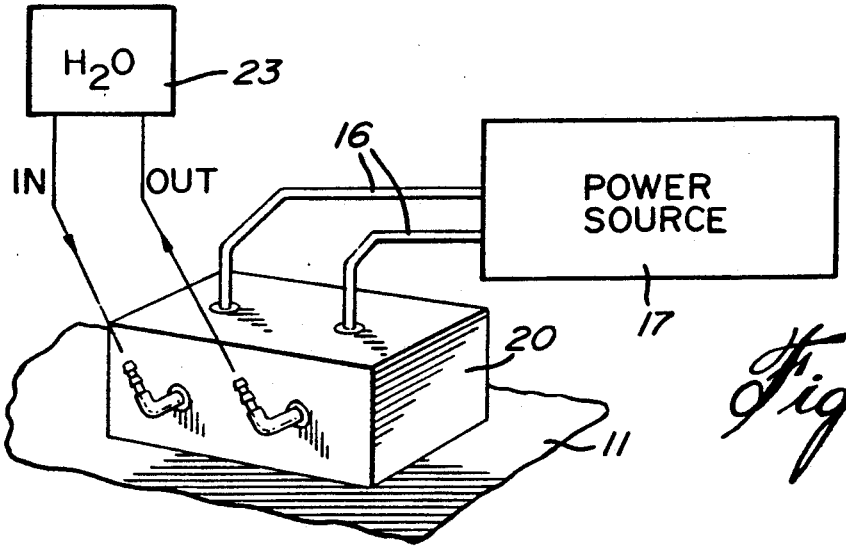
FIG. 2 is a perspective view showing the configuration of the induction heating device of FIG. 1.

The improvement of the induction heating device of the present invention resides in the provision of magnetic flux concentrator tubes 18 being disposed about the coil 15 and in close proximity to the core 12. Concentrator tubes 18 are disposed in a thermo-conductive, electrically-insulating, material 19 and spaced from the core and the coil. One end of the said tubes 18 being electrically insulated from the side plate 22*a* or 22*b* shown in FIG. 1-A. The material 19 is a composite of an epoxy or a synthetic resin generally, and copper or aluminium powder which is disposed in a housing 20. The housing 20, as shown in FIG. 2, is a rectangular housing formed of ceramic powder and fiberglass material. A coat of aluminium paint 21 is disposed on the induction surface of the housing which is disposed in close proximity to the electromagnetic surface to be heated whereby to reduce heat transfer by external radiation back to the induction surface 21 of the housing 20. A metal shield 22, 22*a*, 22*b* is also disposed within the housing 20 and as herein shown, against the top wall and the two sidewalk thereof to electromagnetically shield the inductor.

As shown in FIG. 2, a pressurized water supply 23 is utilized to circulate cooling water through the magnetic flux concentrator tubes 18 whereby to cool the core and the coil in the housing 20 heated by Joule effect at the surface of the tubes and within the coil, and the heat coming from the work piece surface. This cooling effect permits the application of an excitation current in a high frequency range of 12 to 25 kHz whereby the induction heating device 10 can generate from approximately 4 to 25 kW of power while the cooling fluid maintains the internal temperature of the housing to within a temperature of 60° C., these values being non limitative. The concentrator tubes 18 also concentrates the magnetic field produced between the poles 24 and 14. The core inductance also varies within the range of 40 to 125 $\mu$H depending on the size of the core utilized and the frequency of the selected supply, these values being non limitative.

Figure 3:
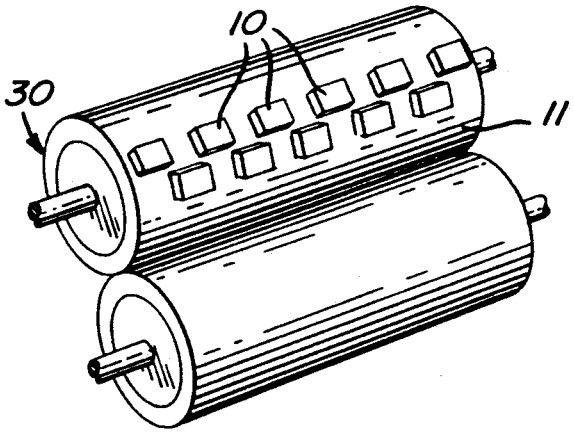
FIG. 3 is a perspective view illustrating the use of the induction heating device of the present invention and as herein shown, a plurality of such devices are disposed in close proximity across a heating calender roll as utilized in a paper making machine to dry a web of paper.
Figure 4:
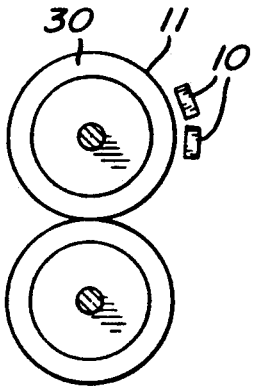
FIG. 4 is an end view of FIG. 3.
Figure 5:
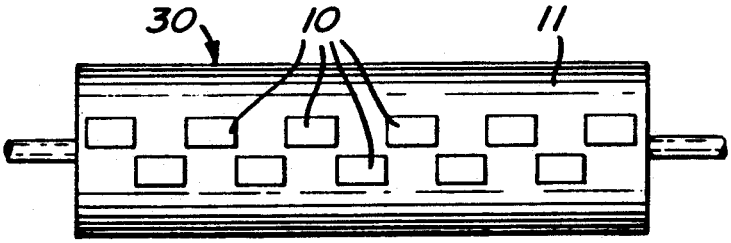
FIG. 5 is a plan view showing the positioning of the inductors across the heating cylinder roll.

Referring now additionally to FIGS. 3 to 5, there is shown a typical application of the electromagnetic induction heating device of the present invention. As herein shown, a plurality of heating devices 10 are disposed in an alternating offset, side-by-side, relationship across a heat calender roll 30 of a papermaking machine (not shown). The heating devices 10 are closely spaced to the roll 30 as shown in FIG. 4 and are stationary with respect to the roll 30 as shown in FIG. 4 and are stationary with respect to the roll 30. Their specific spacing and inter-relationship permits a controlled temperature to be achieved across the width of the roll. These heating devices 10 may also be supplied with electrical power or parallel power in a series array of individually. It is also conceived that heat sensors (not shown) may be provided to sense the temperature across the surface of the roll 30 and utilized to control individual power sources so as to vary the excitation current in their respective coils to individually control the heat generated by these inductors whereby to achieve a required pattern of temperature across the calender roll.

Although FIGS. 3 to 5 relate to an application in the paper making industry, it is pointed out that these induction heaters have numerous other applications and they could, for example, be utilized in other industries for lamination or glazing sheet-like materials. The efficiency of this heating device has also been calculated to be in the order of 95% as calculated by the ratio of the useful heat generated in relation to electrical power used. For example, in the calender roll application, the heating devices of the present invention can generate about 250 kW of heat per meter length of the electrically conductive material used in the construction of the calender roll.

It is within the ambit of the present invention to cover any obvious modifications of the preferred embodiment of the present invention as herein described, provided such modifications fall within the scope of the appended claims.

We claim:

1. An induction heating device for heating electroconductive and mainly ferromagnetic material surfaces to temperatures up to 300° C., said device comprising an open core of ferrite material, a coil of Litz wire wound around said core, a power source connected across said coil to produce an excitation current in said coil within a frequency range of 12 to 25 kHz to generate a magnetic field when energized, magnetic flux concentrator tubes of electrically highly conductive material are disposed between magnetic poles of said core in order to repel and concentrate the magnetic flux lines outside said poles by means of induced eddy currents in said concentrator tubes, said concentrator tubes being placed adjacent to said coil, said concentrator tubes and coil being set into a housing of thermo-conductive, electrically-insulating material and having a cooling fluid circulating through said concentrator tubes for cooling said core and said coil, said magnetic flux lines being able to generate powerful superficial eddy currents and heat in electrically conducting surfaces placed in front of said poles.

2. An induction heating device as claimed in claim 1 wherein said core is a E-shaped core of ferrite material having a high magnetic permeability, said core having opposed arms the ends of which constitutes said opposed poles and a central leg about which said Litz coil is wound.

3. An induction heating device as claimed in claim 1 wherein said housing material is a composite moulded material comprising ceramic powder and fiberglass, said housing being covered with non-electrically conducting and heat-reflecting paint to reduce heat transfer by external radiation back to said induction surface.

4. An induction heating device as claimed in claim 1 wherein said housing is a rectangular housing having a bottom induction surface shaped according to the geometry of the heated workpiece surface, and a metal shield in at least a top wall and two sidewalls of said housing to electromagnetically shield said inductor.

5. An induction heating device as claimed in claim 1 wherein said electrically insulating and thermoconductive material is a composite material comprised of synthetic resins and copper powder.

6. An induction heating device as claimed in claim 1 wherein said electrically insulating and thermoconductive material is a composite material comprised of synthetic resins and aluminum powder.

7. A heating system for heating a moving surface of electrically conductive material to temperatures up to 300° C., said system comprising a plurality of induction heating devices for heating said moving surface which is made of ferromagnetic material, said heating devices being disposed across the direction of movement of said electrically conduction material from opposed edges thereof, each said device comprising an open induction heating device for heating electroconductive and mainly ferromagnetic material surfaces to temperatures up to 300° C., said device comprising an open core of ferrite material, a coil of Litz wire wound around said core, a power source connected across said coil to produce an excitation current in said coil within a frequency range of 12 to 25 kHz to generate a magnetic field when energized, magnetic flux concentrator tubes of electrically highly conductive material are disposed between magnetic poles of said core in order to repel and concentrate the magnetic flux lines outside said poles by means of induced eddy currents in said concentrator tubes, said concentrator tubes being placed adjacent to said coil, said concentrator tubes and coil being set into a thermo-conductive, electrically-insulating material and having a cooling fluid circulating through said concentrator tubes for cooling said core and said coil, said magnetic flux lines being able to generate powerful superficial eddy currents and heat in electrically conducting surfaces placed in front of said poles.

8. A heating system as claimed in claim 7, wherein said moving surface is an outer surface of a heating roll for use in heat treatment of sheet-like materials.

9. An induction heating device as claimed in claim 7 wherein said heating devices each have a rectangular shaped induction surface, said induction surfaces of said plurality of heating devices being disposed in an alternating offset side-by-side relationship across said heating roll.

* * * * *